US009734655B2

(12) United States Patent
Singer et al.

(10) Patent No.: US 9,734,655 B2
(45) Date of Patent: Aug. 15, 2017

(54) SYSTEM AND METHOD OF ACCUMULATING AND RECORDING OUTCOMES GENERATED BY A GAMING DEVICE

(71) Applicant: PTT, LLC, New York, NY (US)

(72) Inventors: Anthony Singer, New York, NY (US); Howard Marks, Scarsdale, NY (US); Daniel Marks, Decatur, GA (US)

(73) Assignee: High 5 Games, LLC, New York, NY (US)

( * ) Notice: Subject to any disclaimer, the term of this patent is extended or adjusted under 35 U.S.C. 154(b) by 192 days.

(21) Appl. No.: 14/509,018

(22) Filed: Oct. 7, 2014

(65) Prior Publication Data

US 2015/0206379 A1 Jul. 23, 2015

Related U.S. Application Data

(63) Continuation of application No. 11/975,255, filed on Oct. 18, 2007, now Pat. No. 8,851,975, which is a continuation of application No. 11/455,292, filed on Jun. 15, 2006, now Pat. No. 7,837,553, which is a continuation of application No. 10/438,325, filed on May 15, 2003, now Pat. No. 7,278,914, which is a continuation of application No. 10/105,942, filed on Mar. 26, 2002, now Pat. No. 6,935,947.

(60) Provisional application No. 60/289,633, filed on May 9, 2001.

(51) Int. Cl.

| | |
|---|---|
| *A63F 9/24* | (2006.01) |
| *G07F 17/32* | (2006.01) |
| *G07F 17/34* | (2006.01) |

(52) U.S. Cl.
CPC ..... *G07F 17/3213* (2013.01); *G07F 17/32* (2013.01); *G07F 17/3239* (2013.01); *G07F 17/34* (2013.01)

(58) Field of Classification Search
USPC ..... 463/22, 17, 18
See application file for complete search history.

(56) References Cited

U.S. PATENT DOCUMENTS

| | | | | |
|---|---|---|---|---|
| 2004/0214631 | A1* | 10/2004 | Devaull | G07F 17/32 463/20 |
| 2006/0252512 | A1* | 11/2006 | Walker | G07F 17/3244 463/25 |
| 2010/0248818 | A1* | 9/2010 | Aoki | G07F 17/3244 463/25 |
| 2011/0230251 | A1* | 9/2011 | Nicely | G07F 17/32 463/20 |

(Continued)

*Primary Examiner* — Pierre E Elisca
(74) *Attorney, Agent, or Firm* — Jon Fallon, Esq.; Candice Hebden Osnato, Esq.

(57) ABSTRACT

The present invention provides a variety of systems and methods of playing a slot machine game in which players accumulate elements during one or more spins and at the conclusion of any spin may record the accumulation of said elements for future use at the same or different slot machine game. In three preferred embodiments, a player accumulates: the cumulative number of times one or more predetermined symbols appear in the symbol matrix; the cumulative number of points awarded by the game for winning symbol combinations appearing in the symbol matrix; or a set of predetermined winning symbol combinations.

19 Claims, 15 Drawing Sheets

(56) References Cited

U.S. PATENT DOCUMENTS

2012/0122561 A1* 5/2012 Hedrick ..... G07F 17/32
463/25

* cited by examiner

BIG TICKET GAMES

SYSTEM AND METHOD OF ACCUMULATING AND RECORDING OUTCOMES GENERATED BY A GAMING DEVICE

PRIORITY CLAIMS AND RELATED APPLICATIONS

This application is a continuation of U.S. application Ser. No. 11/975,255, filed Oct. 18, 2007, which is a continuation-in-part of U.S. application Ser. No. 11/455,292, filed on Jun. 15, 2006, which is a continuation-in-part of U.S. application Ser. No. 10/438,325, filed May 15, 2003, which is a continuation-in-part of U.S. application Ser. No. 10/105,942, filed Mar. 26, 2002, now U.S. Pat. No. 6,935,947, which claims priority from U.S. Provisional Application No. 60/289,633, filed on May 9, 2001.

COPYRIGHT NOTICE

A portion of the disclosure of this patent document contains or may contain material subject to copyright protection. The copyright owner has no objection to the photocopy reproduction of the patent document or the patent disclosure in exactly the form it appears in the Patent and Trademark Office patent file or records, but otherwise reserves all copyright rights.

FIELD OF THE INVENTION

In general, the present invention relates to methods of operating slot machine games and gaming devices. More specifically, the present invention provides a system and method of accumulating elements generated by the slot machine game during one or more spins and, upon cashing out of the game, recording the accumulation of said elements for future use at the same or different slot machine game.

BACKGROUND OF THE INVENTION

To play a conventional slot machine, the player deposits money into the machine, sets the wager, spins the reels, and collects awards for winning symbol according to a pay schedule. Since conventional slot machines are limited to the foregoing methods, players, casinos, and manufacturers suffer from repetition. Players grow bored of playing games using the same method of play; casinos suffer from player dissatisfaction with the casino's game selection; casinos cannot distinguish their games from other casinos; and game manufacturers cannot distinguish their products from other manufacturers.

Casino operators and slot manufacturers, therefore, have developed new methods of playing slot machines to overcome these limitations. One of these methods provides for the accumulation of elements over the course of multiple games with an award for accumulating a predetermined number of elements. For example, the Cherry Pie game from International Game Technology accumulates each cherry symbol that appears on the slot reels from spin to spin and issues an award upon the accumulation of a predetermined number of cherry symbols. These multiple spin, incremental accumulation games, however, require that the player continue playing until completing the accumulation of elements and generating an award. Players that cannot continue playing, tire of playing, or run out of funds to play the game must surrender the time, effort and value of their accumulated elements to another player.

Thus, there is a need for a system and method of playing a slot machine game in which a player may accumulate elements generated by the game during one or more spins and, upon cashing out of the game, record any accumulated elements for future use at the same or different slot machine game. It is an objective of the present invention to satisfy this need.

SUMMARY OF THE INVENTION

The present invention provides a variety of systems and methods of playing a slot machine game in which a player may accumulate elements generated by the game during one or more spins and, upon cashing out of the game, record any partial accumulation of said elements for future use at the same or different slot machine game. In a preferred embodiment of the present invention, a player accumulates the number of times one or more predetermined symbols appear in the symbol matrix. The player may collect awards for accumulating predetermined numbers of said symbols. Any accumulated symbols used to collect an award are deducted from the player's cumulative total. Upon cashing out of the game, the player records the remaining number of accumulated symbols using a printed ticket. The ticket then provides a starting point from which the player may continue playing and accumulating more symbols on the same or different gaming device.

In another preferred embodiment of the present invention, a player accumulates points for predetermined symbol combinations appearing in the symbol matrix. The player may collect awards for accumulating a specific number of points and/or exceeding predetermined numbers of points. Upon cashing out of the game, the player records the number of accumulated points using a printed ticket. The ticket then provides a starting point from which the player may continue playing and accumulating more points on the same or different gaming device.

In another preferred embodiment of the present invention, a player accumulates members from a set of predetermined symbol combinations. The player collects an award for accumulating at least one member in the set. All of the accumulated members are removed with the issuance of an award. Upon cashing out of the game, the player uses a ticket printer to record all of the members accumulated by the player and denote the remaining members required to complete the set of symbol combinations. The ticket then provides a starting point from which the player may continue accumulating members on the same or different gaming device.

In a further preferred embodiment that may be incorporated and combined with any of the aforementioned embodiments, the gaming device is linked via a computer network to a central server which tracks the usage of each gaming machine (also called a "player tracking system"). The player tracking system may then be used to store, validate, and retrieve the information printed on the tickets, including the number and/or type of elements accumulated by the player. Moreover, the use of such a player tracking system may lead to the development of a ticketless embodiment which provides for the storage, validation and retrieval of accumulated elements using a player identification card or other identification method.

BRIEF DESCRIPTION OF THE DRAWINGS

The accompanying figures illustrate various stages of the preferred embodiments of the present invention.

DESCRIPTION OF A PREFERRED EMBODIMENT

Figure 1:
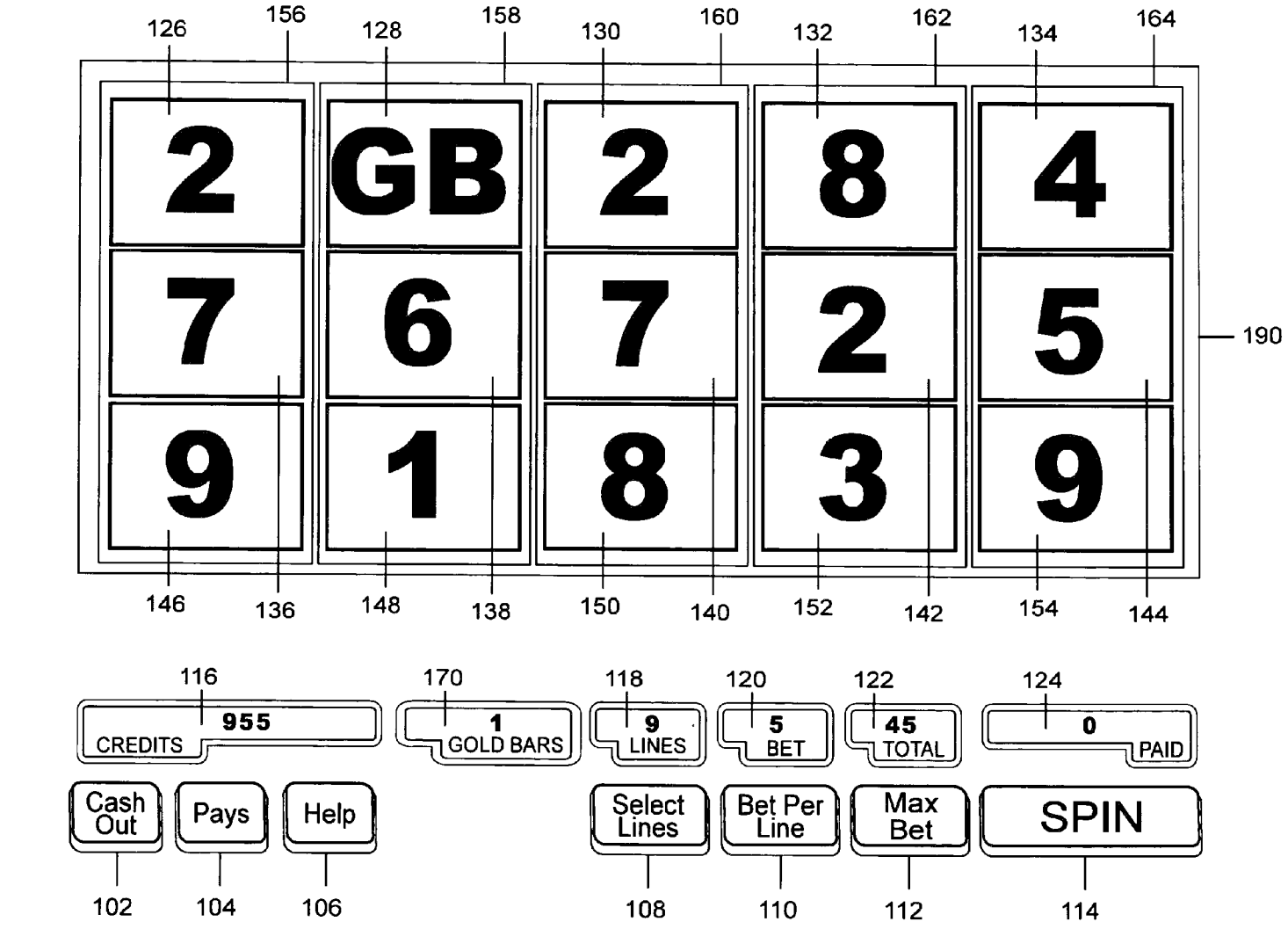
FIG. 1 shows a first representative game screen in which the player accumulates the number of times a predetermined symbol appears in the symbol matrix.

To play the preferred embodiments of the present invention, the player initializes credits, sets the wager, spins the reels, collects awards for winning symbol combinations, accumulates elements, and, upon cashing out of the game, records any accumulated elements using a ticket printer, as detailed below with reference to FIGS. 1 to 12 (collectively "Figures").

Initialize Credits.

In the Figures, the player initializes credits by depositing money in the form of coins, gaming tokens or paper currency into a coin head (not shown) or bill acceptor (not shown). Coins and gaming tokens are collected in a reservoir (not shown) inside the gaming machine; paper currency is collected in the bill acceptor (not shown) inside the gaming machine.

If the coins, gaming tokens or paper currency are validated as authentic, the player accrues the appropriate number of playing credits on the Credit meter 116. More credits may be initialized, if necessary, by additional deposits. Alternatively, any method of initializing credits may be used including debit cards, credit cards, or other form of electronic funds transfer.

Set the Wager.

In the Figures, the player sets the wager by selecting pay lines and setting the bet per pay line. The wager is calculated by multiplying the number of selected pay lines by the bet per pay line. For example, the player may wager five credits on each of nine pay lines for a total bet of forty-five credits. The total bet amount is displayed on the Total Bet meter 122.

To select pay lines, the player uses the Select Pay Lines button 108 and views the number of selected pay lines on the Select Pay Lines meter 118. The player uses the Select Pay Lines button to select pay lines in a predetermined order. For example, the first pay line selected is always pay line 1, second pay line selected is always pay line 2, etc. Alternatively, fewer or greater than nine pay lines may be used with any order of pay line activation.

To set the bet per pay line, the player uses the Bet Per Pay Line button 110 and views the amount bet per pay line on the Bet Per Pay Line meter 120. The same amount is wagered on each pay line. For example, up to five credits may be wagered on each pay line.

Alternatively, wagers of any amount may be placed on a pay line, with the same or different amount wagered on each pay line.

In addition, the player may use the Bet Max button 112 to place the maximum bet per pay line on all pay lines. Alternatively, any wager may be assigned a button.

Spin the Reels.

In the Figures, the player uses the Spin button 114 to randomly rearrange the symbols displayed in the symbol matrix 190. The symbol matrix 190 contains three symbol positions in each of the five columns 156-164 for a total of fifteen symbol positions 126-154.

The columns 156-164 are each associated with a reel strip, with each column 156-164 displaying three symbol positions 126-154 from the associated reel strip. Alternatively, any number of reel strips may be used to display symbols in symbol positions 126-154 of the symbol matrix 190. For each spin, the reel strips rotate and randomly stop one at-a-time until all of the columns 156-164 have stopped and each of the 15 symbol positions 126-154 display a symbol from the reel strip. Alternatively, any size symbol matrix with any number of symbol positions may be used with any method of rearranging the symbols in the symbol matrix.

Winning Symbol Combinations.

Following a spin of the reels, the player collects credit awards for all winning combinations, if any, according to a pay schedule. Winning combinations may include symbols that appear in specific positions, in a specific order on a pay line ("line pays"); symbols anywhere on a pay line ("line scatter pays"); or symbols anywhere on the slot reels ("reel scatter pays"). Some or all of these winning combinations may be available in the pay schedule.

The number of credits awarded for a winning combination depends on the selected pay schedule and the credits wagered. For line pays and line scatter pays, the number of credits wagered on the winning pay line multiplies the number of credits indicated by the selected pay schedule.

For reel scatter pays, the total number of credits wagered multiplies the number of credits indicated by the selected pay schedule.

Accumulate and Record Elements.

Figure 2A:
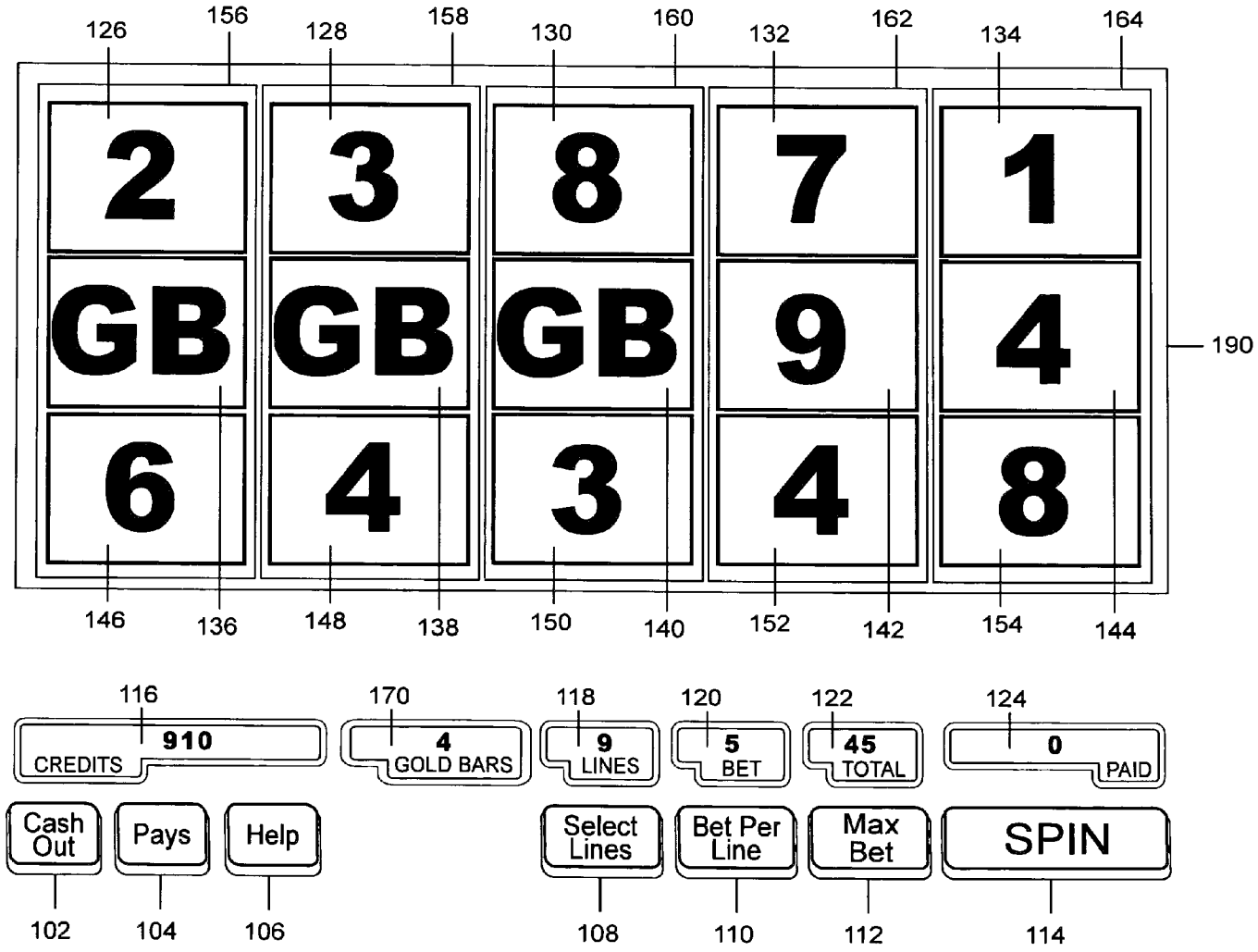
FIG. 2A shows a second representative game screen in which the player accumulates the number of times a predetermined symbol appears in the symbol matrix; prior to issuance of an award based upon the number of accumulated symbols.
Figure 2B:
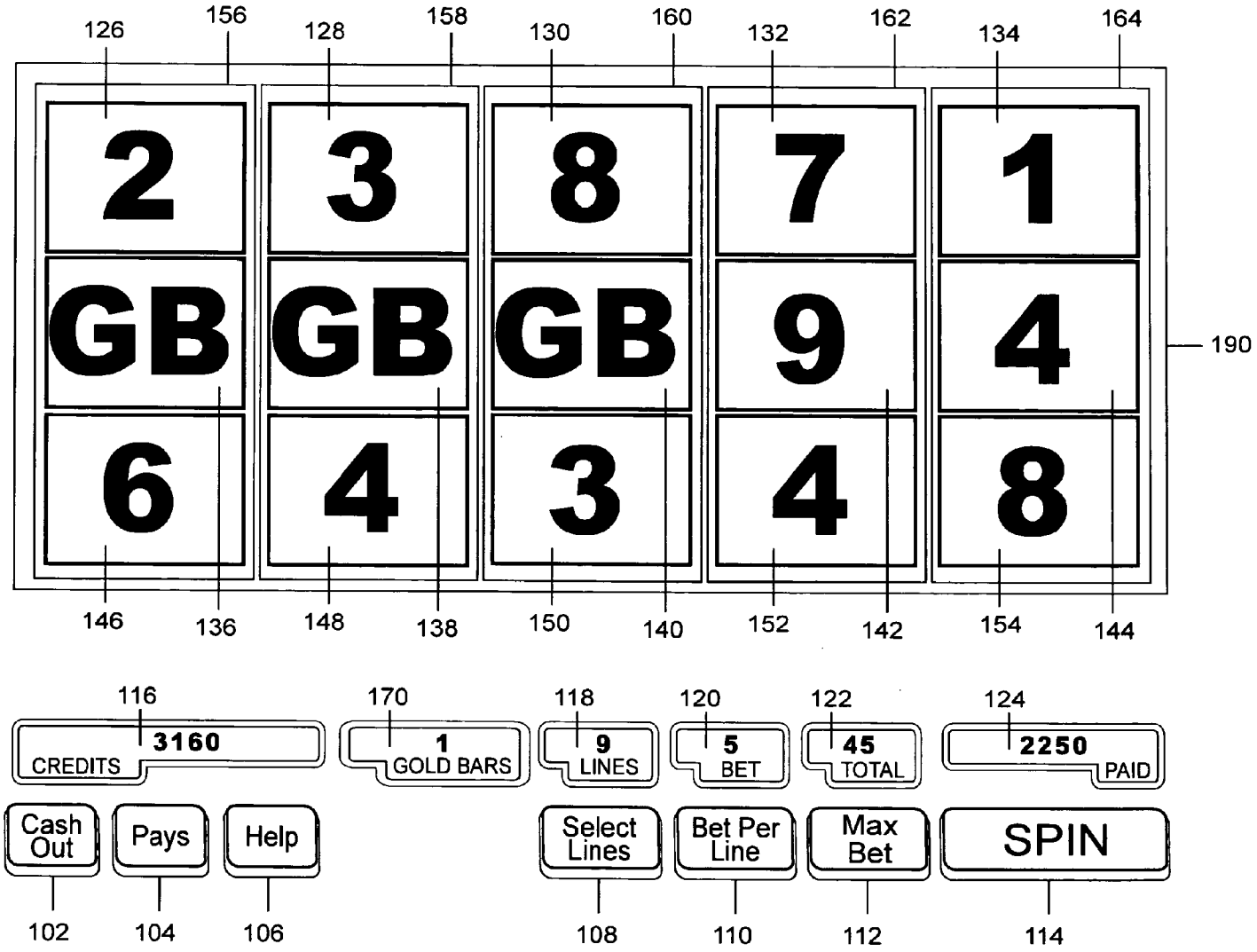
FIG. 2*b* shows a second representative game screen in which the player accumulates the number of times a predetermined symbol appears in the symbol matrix; following the issuance of an award based upon the number of accumulated symbols.
Figure 3:
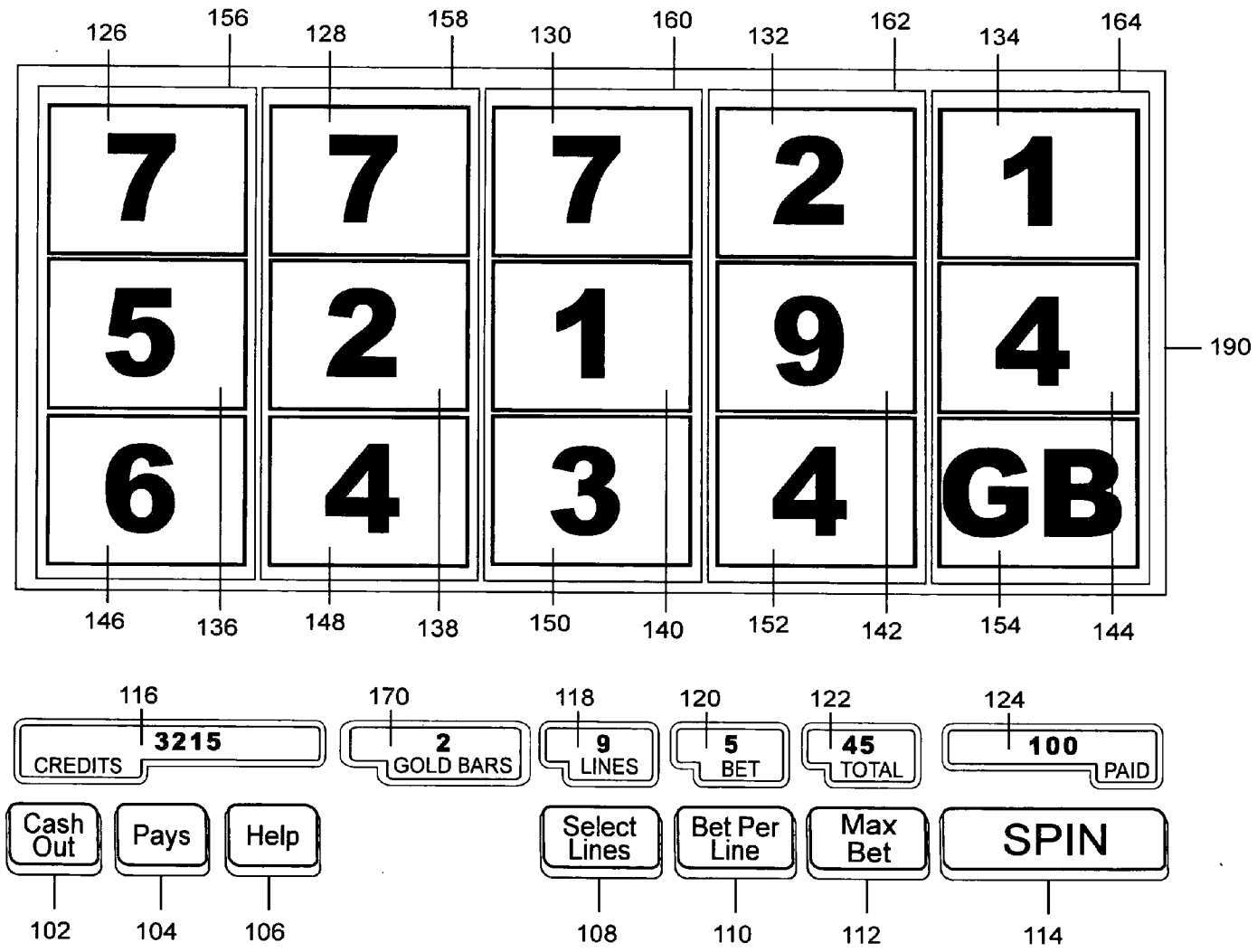
FIG. 3 shows a third representative game screen in which the player accumulates the number of times a predetermined symbol appears in the symbol matrix.
Figure 4:
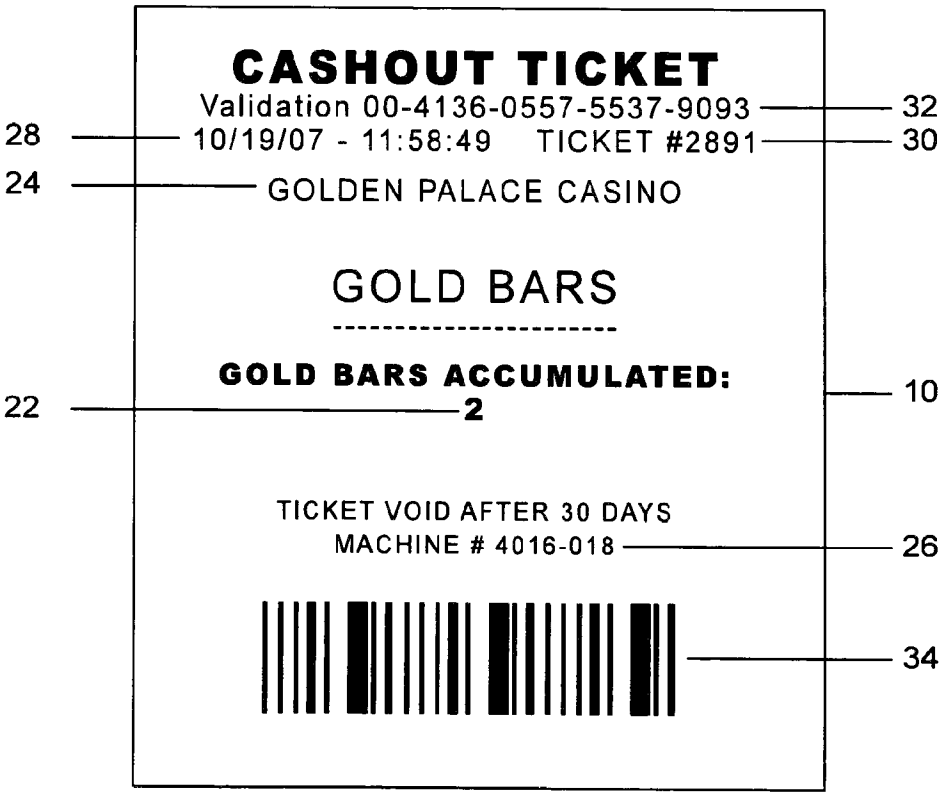
FIG. 4 shows a printed ticket displaying the number of predetermined symbols accumulated by the player.

In addition to collecting awards for winning symbol combinations, the player may also accumulate and record elements generated by the game during the play of one or more spins. Specifically, FIGS. 1 to 12 illustrate three preferred methods by which the player may accumulate and record said elements:

FIGS. 1, 2, and 3 illustrate the "Gold Bar" preferred embodiment in which the player accumulates the cumulative number of times a "Gold Bar" symbol appears in the symbol matrix 190. FIG. 4 provides an example of using a ticket printer to record the elements accumulated during a gaming session of the "Gold Bar" preferred embodiment.

In FIG. 1, a Gold Bar symbol (shown as "GB" in the Figures) appears in the symbol matrix 190 in the top position 128 of the second column 158. The number of cumulative Gold Bar symbols accumulated by the player increases from 0 to 1, as shown on the accumulated Gold Bar meter 170. The Gold Bar symbol does not act as a wildcard symbol to help form winning combinations and, therefore, does not act as a "2" symbol to help form a winning "2-2-2" symbol combination with the "2" symbols in the top position of the first column 126 and third column 130. Thus, the symbol matrix does not display any winning symbol combinations and zero award credits issue to the player, as shown on the Paid meter 124.

In FIG. 2*a*, a Gold Bar symbol (shown as "GB" in the Figures) appears in the symbol matrix 190 in the middle position 136 of the first column 156, the middle position 138 of the second column 158, and the middle position 140 of the third column 160. The number of cumulative Gold Bar symbols accumulated by the player increases from 1 to 4, as shown on the accumulated Gold Bar meter 170. The Gold Bar Symbol does not form a winning symbol combination by itself and, therefore, does not generate its own winning "GB-GB-GB" symbol combination. Thus, the symbol matrix does not display any winning symbol combinations and zero award credits for winning symbol combinations issue to the player.

In the Gold Bar embodiment, the game issues an award for every 3 Gold Bar symbols accumulated by the player. With the accumulation of 4 Gold Bar symbols, as shown on the Gold Bar meter 170 in FIG. 2*a*, the player has attained the necessary number of Gold Bars to generate a Gold Bar award.

In FIG. 2*b*, the game issues a Gold Bar award to the player of fifty times the total wager, or 2250 credits, as shown on the Paid meter 124. The accumulated Gold Bars used to generate the Gold Bar award are deducted from the player's accumulated Gold bars, or 3 Gold Bars are deducted from the total of 4 Gold bars. The player, however, retains 1 unused Gold Bar symbol, as shown on the Gold Bar meter 170.

In FIG. 3, a Gold Bar symbol (shown as "GB" in the Figures) appears in the symbol matrix 190 in the bottom position 154 of the fifth column 164. The number of cumulative Gold Bar symbols accumulated by the player increases from 1 to 2, as shown on the accumulated Gold Bar meter 170. The Gold Bar symbol does not prevent the formation of winning symbol combinations by other symbols in the symbol set. Thus, the symbol matrix displays a winning "7-7-7" symbol combination in the top positions 126,128,130, of first 156, second 158, and third columns 160 and awards 100 credits to the player in accordance with a pay schedule (not shown), with the 100 credit award shown on the Paid meter 124. The credit award is added to the player's balance of credits, as shown on Credit meter 116.

As long as the player has credits on the Credit meter 116, the player may continue to play the game or the player may also collect the balance of credits by pressing the Cash Out button 102. In addition, the player may press the Help button 106 to view the rules of the game.

In FIG. 4, the player has decided to cash out of the Gold Bar embodiment of the game and upon cashing out receives a ticket 10 displaying the number (i.e. 2) of Gold Bars symbols accumulated at 22 by the player during the three games of the player's gaming session (as shown in FIGS. 1-3). In addition, the ticket 10 includes the name of gaming location 24, a unique identifier of the gaming machine 26, the time and date of the issuance of the ticket 28, ticket identification number 30, and a secure validation code in alpha-numeric 32 and bar code 34 formats. Alternatively, a ticket produced by the Gold Bar embodiment may include any other information, such as the player's unique identification code, to be displayed in any form, such as bar coding, and/or include any form of security mechanism, such as holographic decals or magnetic striping.

The player uses a Gold Bar ticket 10 to store the accumulated Gold Bars for future use at the same or different gaming machine. Upon deciding to play another game session using the "Gold Bars" embodiment, the player may insert the ticket 10 into a ticket acceptor or reader (not shown). Upon validation of the ticket 10 by the stand alone gaming device, a network connecting multiple gaming machines to central servers, or other validation mechanism, the player then receives the accumulated number of Gold Bars, as shown on the ticket 10 at 22, and may proceed to continue accumulating more Gold Bars with additional game play (as described in the Gold Bar embodiment above).

Figure 5:
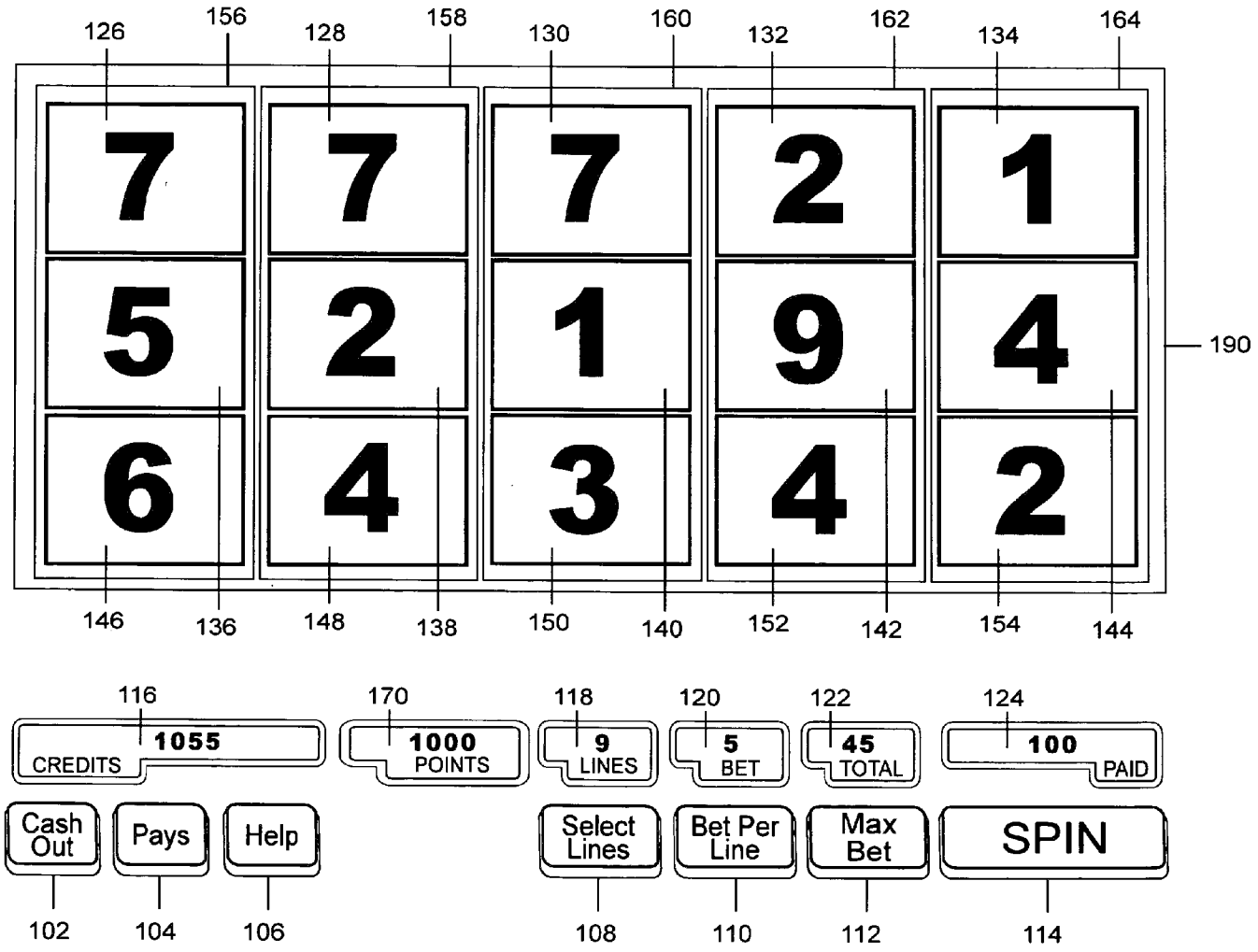
FIG. 5 shows a first representative game screens in which the player accumulates the total number of points for predetermined symbol combinations appearing in the symbol matrix.
Figure 6:
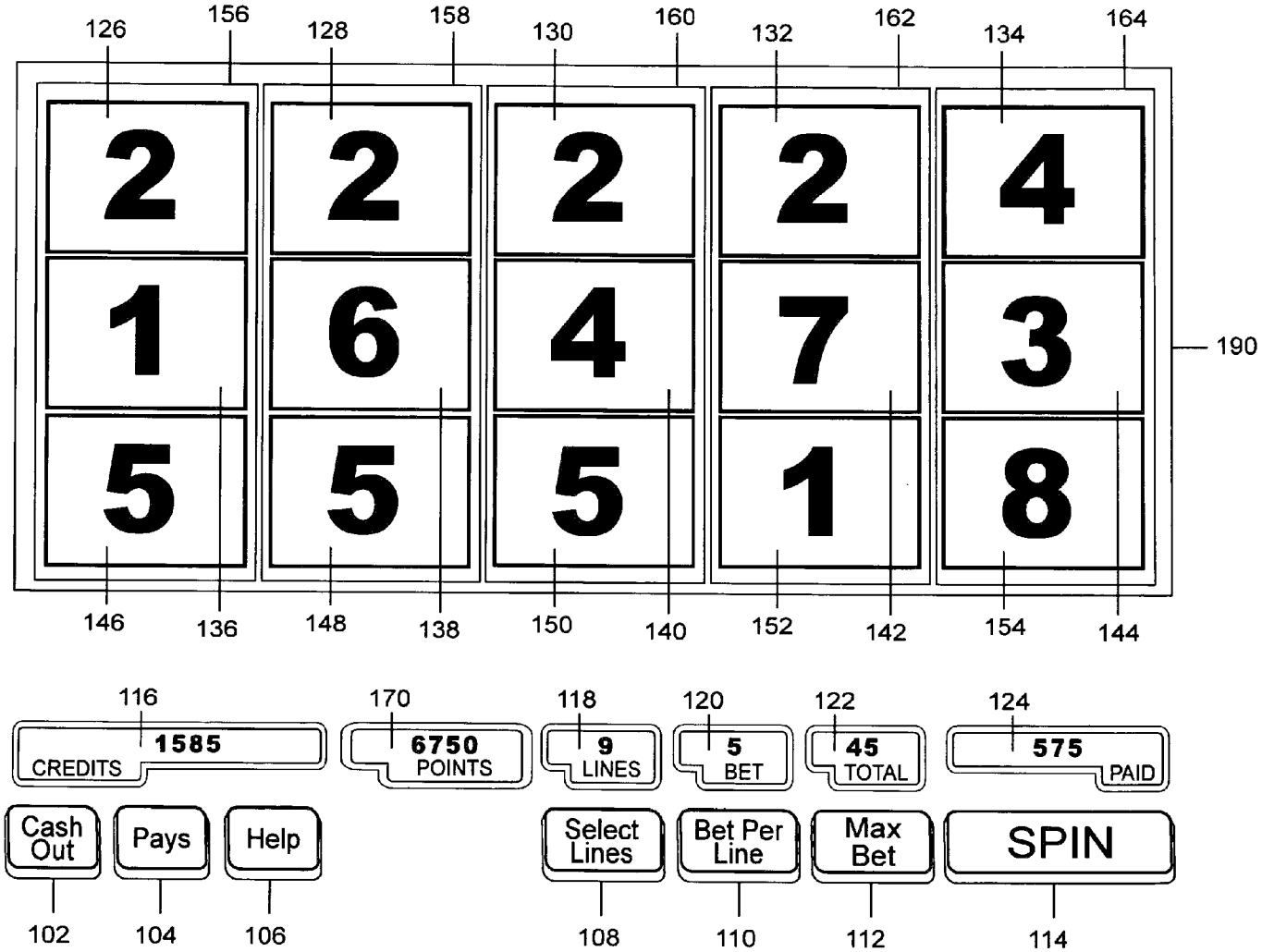
FIG. 6 shows a second representative game screens in which the player accumulates the total number of points for predetermined symbol combinations appearing in the symbol matrix.
Figure 7:
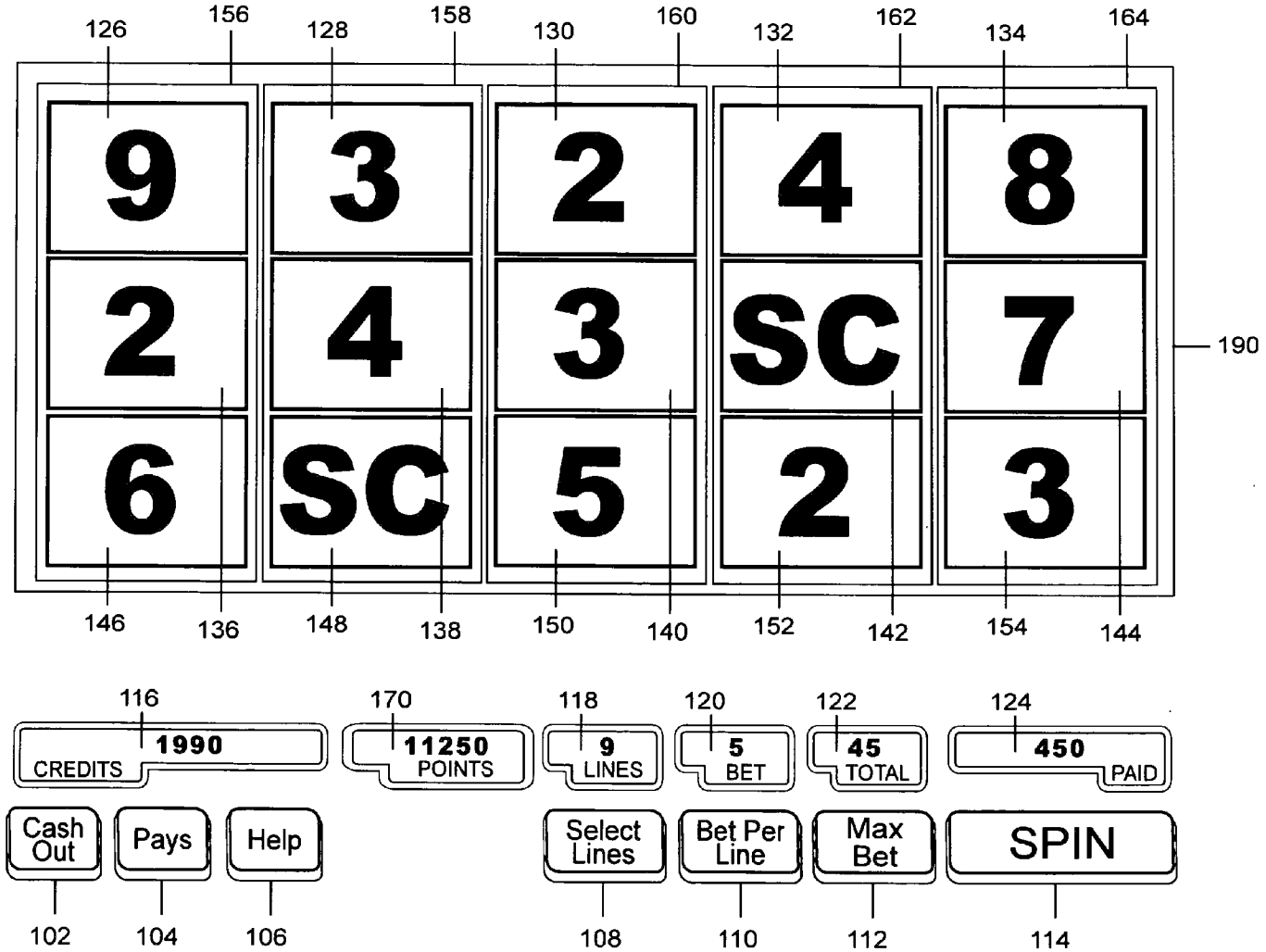
FIG. 7 shows a third representative game screens in which the player accumulates the total number of points for predetermined symbol combinations appearing in the symbol matrix.
Figure 8:
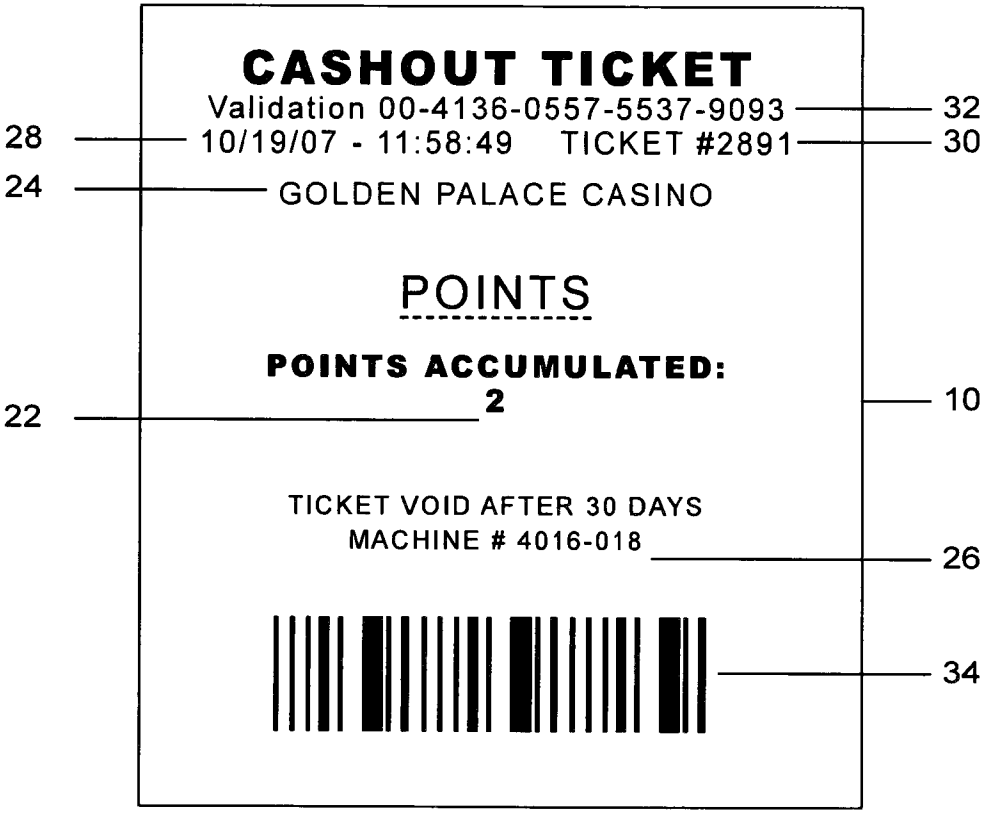
FIG. 8 shows a printed ticket displaying the total number of points for predetermined symbol combinations accumulated by the player.

FIGS. 5, 6, and 7 illustrate the "Points" preferred embodiment in which the player accumulates the points based upon the appearance of winning symbol combinations in the symbol matrix 190. FIG. 8 provides an example of using a ticket printer to record the points accumulated during a gaming session of the "Points" preferred embodiment.

In FIG. 5, a winning 7-7-7 symbol combination appears in the top positions 126, 128, 130, of first 156, second 158, and third columns 160 and awards 100 credits to the player in accordance with a pay schedule (not shown), with the 100 credit award shown on the Paid meter 124. The game also awards ten points for each award credit generated by a winning symbol combination, or 1000 points. Thus, the number of points accumulated by the player increases from 0 to 1000, as shown on the accumulated Points meter 170.

In FIG. 6, two winning symbol combinations appear in symbol matrix 190. The first winning 2-2-2-2 symbol combination appears in the top positions 126,128,130,132 of first 156, second 158, third 160 and fourth columns 162 and awards 500 credits to the player in accordance with a pay schedule (not shown); the second winning 5-5-5 symbol combination appears in the bottom positions 146, 148, 150 of first 156, second 158, and third 160 columns and awards 75 credits to the player in accordance with a pay schedule (not shown). The total award of 575 credits for both winning symbol combinations is shown on the Paid meter 124. The game also awards ten points for each award credit generated by the two winning symbol combinations, or 5750 points. Thus, the number of points accumulated by the player increases from 1000 to 6750, as shown on the accumulated Points meter 170.

In FIG. 7, a scatter symbol (shown as "SC" in the Figures) appears in the symbol matrix 190 in the bottom position 148 of the second column 158 and the middle position 142 of the fourth column 162 and awards the player 10 times the total wager, or 450 credits, in accordance with a pay schedule (not shown). The game also awards ten points for each award credit generated by the scatter symbol combination, or 4500 points. Thus, the number of points accumulated by the player increases from 6750 to 11250, as shown on the accumulated Points meter 170.

As long as the player has credits on the Credit meter 116, the player may continue to play the game or the player may also collect the balance of credits by pressing the Cash Out button 102. In addition, the player may press the Help button 106 to view the rules of the game.

In FIG. 8, the player has decided to cash out of the Points embodiment of the game and upon cashing out receives a ticket 10 displaying the number of points (i.e. 11250) accumulated at 22 by the player during the three games of the player's gaming session (as shown in FIGS. 5-7). In addition, the ticket 10 includes the name of gaming location 24, a unique identifier of the gaming machine 26, the time and date of the issuance of the ticket 28, ticket identification number 30, and a secure validation code in alpha-numeric 32 and bar code 34 formats. Alternatively, a ticket produced by the Points embodiment may include any other information, such as the player's unique identification code, to be displayed in any form, such as bar coding, and/or include any form of security mechanism, such as holographic decals or magnetic striping.

The player uses a Points ticket 10 to store the accumulated points for future use at the same or different gaming machine. Upon deciding to play another game session using the "Points" embodiment, the player may insert the ticket 10 into a ticket acceptor or reader (not shown). Upon validation of the ticket 10 by the stand alone gaming device, a network connecting multiple gaming machines to central servers, or other validation mechanism, the player then receives the accumulated number of points, as shown on the ticket 10 at 22, and may proceed to continue accumulating more points with additional game play (as described in the Points embodiment above).

Figure 10A:
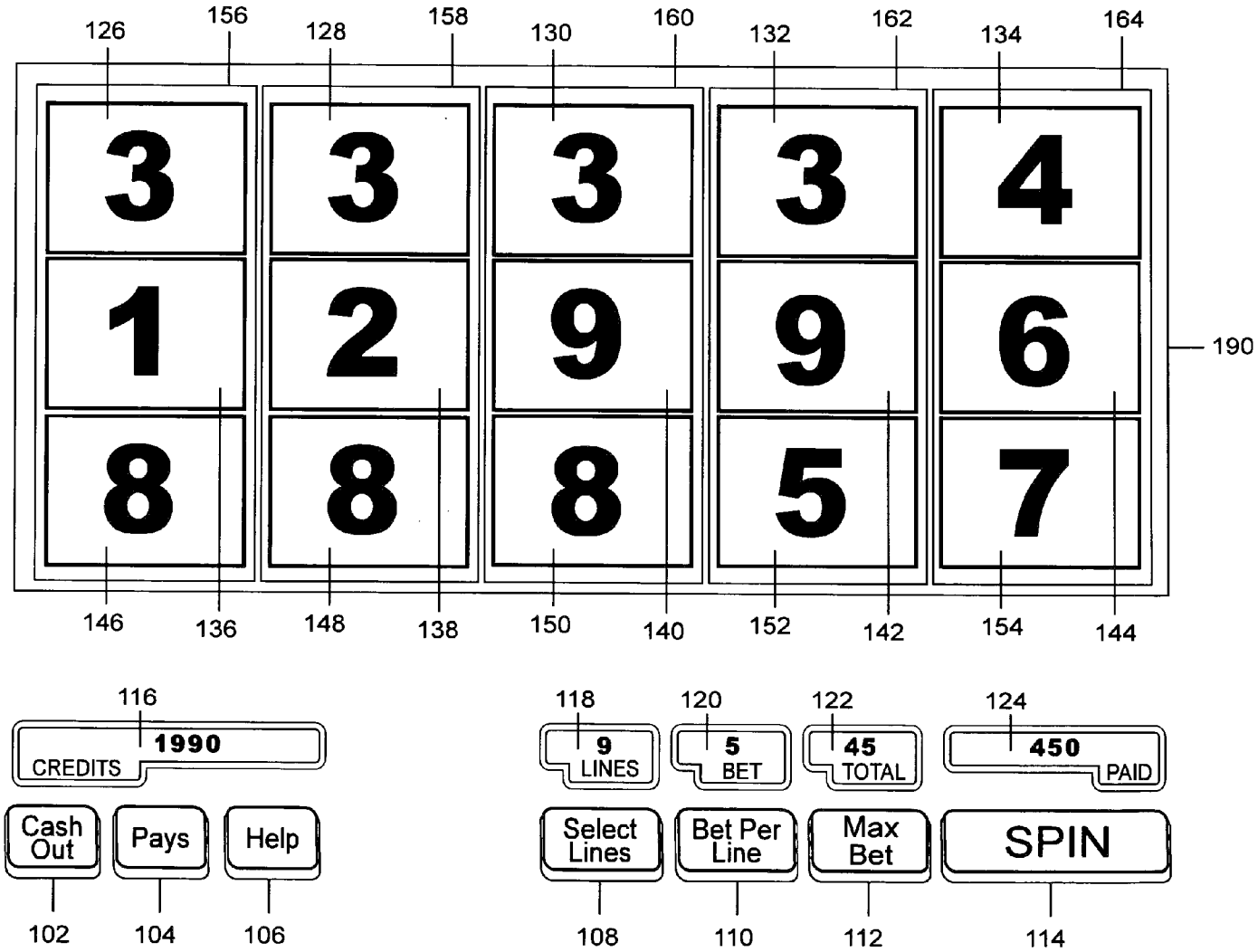
FIG. 10*a* shows a second representative game screen in which the player accumulates members from a set of symbol combinations.
Figure 10B:
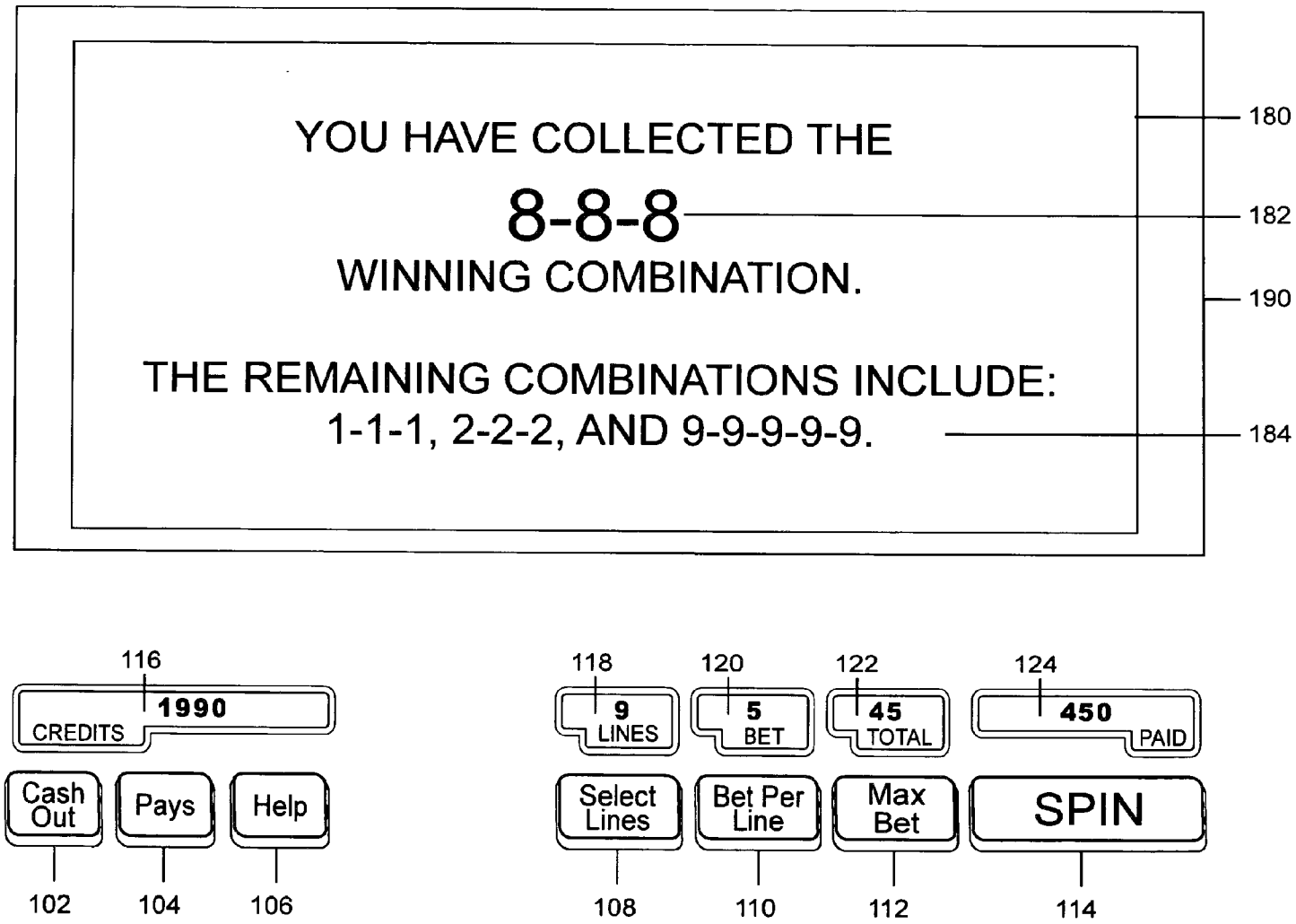
FIG. 10*b* shows a representative message screen indicating the specific member accumulated from a set of symbol combinations.
Figure 11:
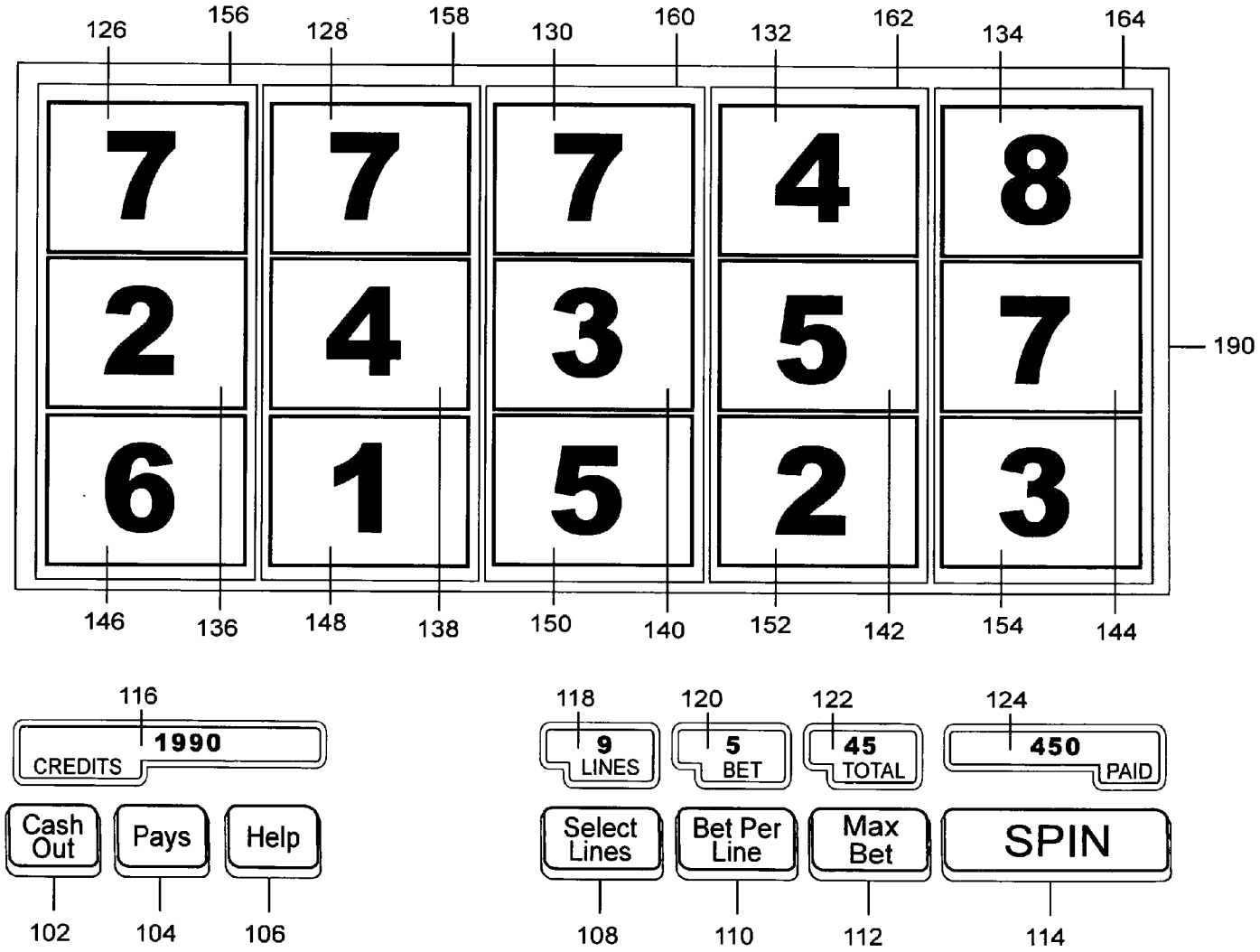
FIG. 11 shows a third representative game screen in which the player accumulates members from a set of symbol combinations.
Figure 12:
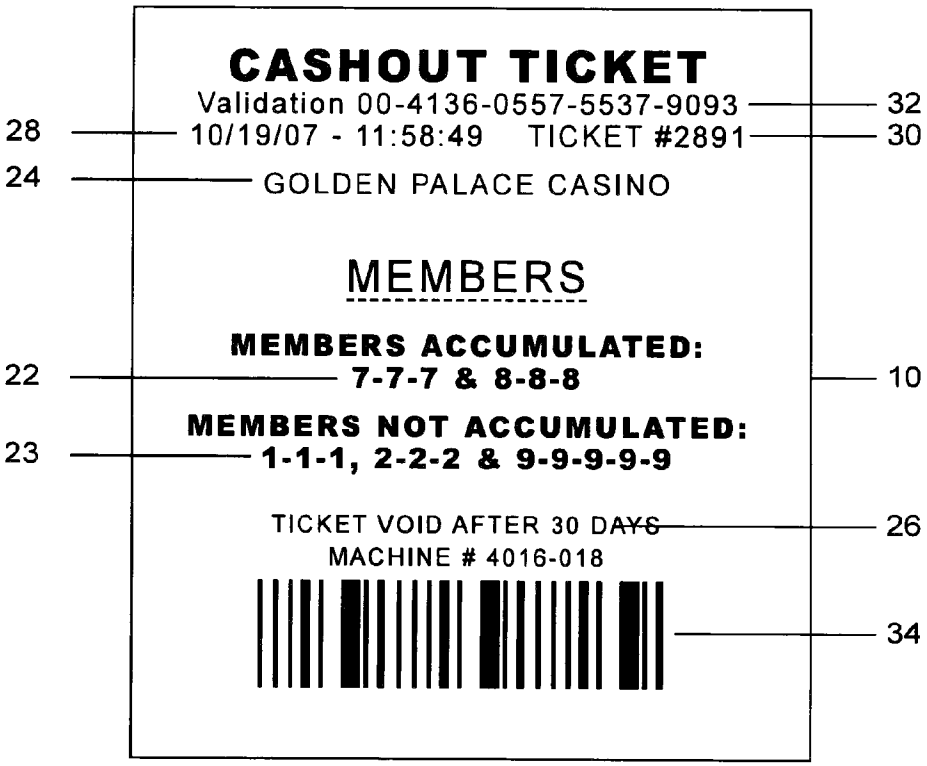
FIG. 12 shows a printed ticket displaying the specific symbol combinations accumulated by the player from a set of symbol combinations.

FIGS. 9, 10, and 11 illustrate the "Members" preferred embodiment in which the player accumulates the members from a set of predetermined winning symbol combinations. FIG. 12 provides an example of using a ticket printer to record the specific winning symbol combinations accumulated during a gaming session of the "Members" preferred embodiment.

Figure 9A:
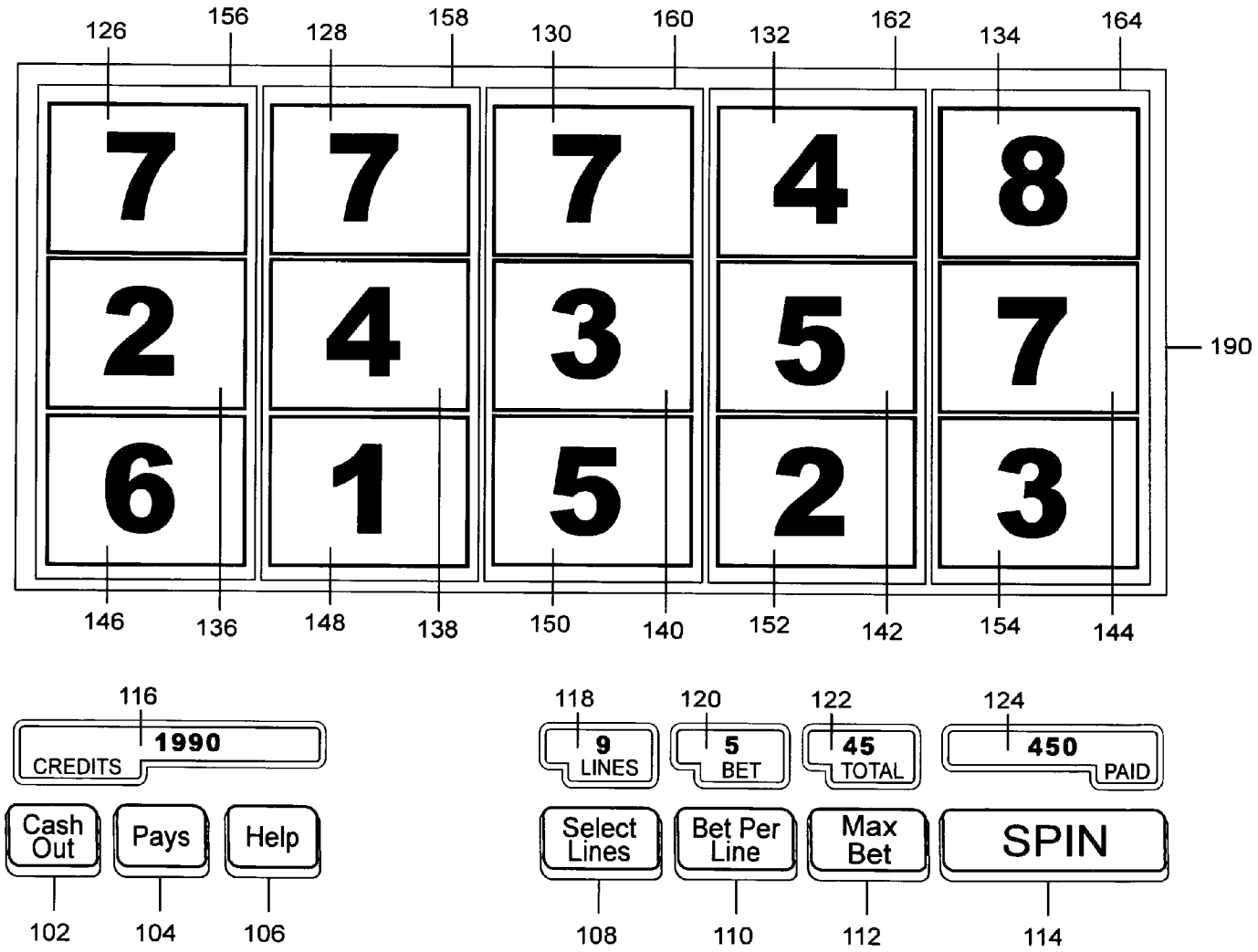
FIG. 9*a* shows a first representative game screen in which the player accumulates members from a set of symbol combinations.
Figure 9B:
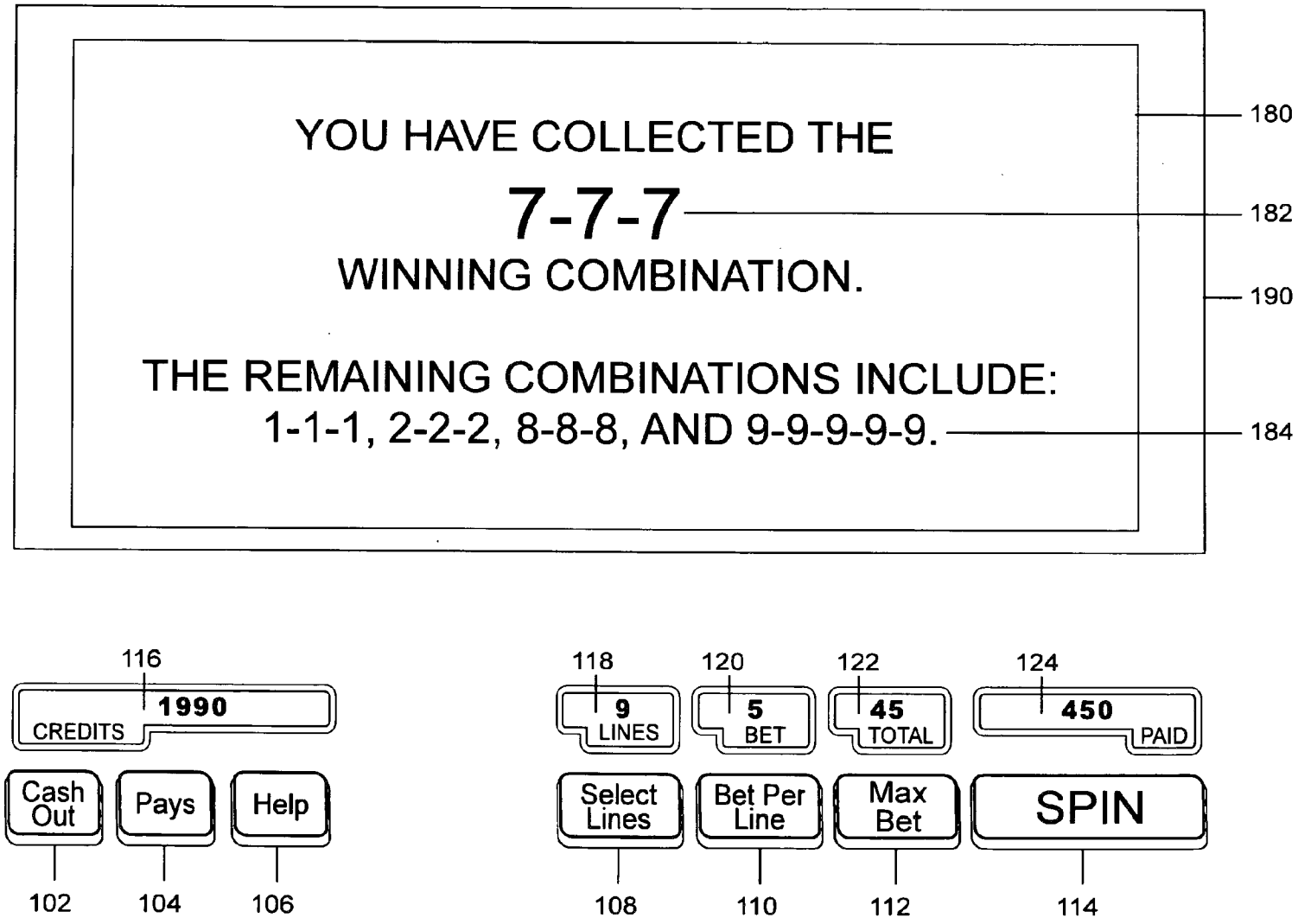
FIG. 9*b* shows a representative message screen indicating the specific member accumulated from a set of symbol combinations.

In FIG. 9*a*, a winning 7-7-7 symbol combination appears in the top positions 126, 128, 130, of first 156, second 158, and third columns 160 and awards 100 credits to the player in accordance with a pay schedule (not shown), with the 100 credit award shown on the Paid meter 124. In FIG. 9*b*, the game indicates that the player has accumulated the 7-7-7 symbol combination 182 and the list of remaining predetermined symbol combinations 184 shown on the information window 180 that appears in the symbol matrix 190.

In FIG. 10*a*, two winning symbol combinations appear in symbol matrix 190. The first winning 3-3-3-3 symbol combination appears in the top positions 126,128,130,132 of first 156, second 158, third 160 and fourth columns 162 and awards 800 credits to the player in accordance with a pay schedule (not shown); the second winning 8-8-8 symbol combination appears in the bottom positions 146, 148, 150 of first 156, second 158, and third 160 columns and awards 275 credits to the player in accordance with a pay schedule (not shown). The total award of 1075 credits for both winning symbol combinations is shown on the Paid meter 124. In FIG. 10*b*, the game indicates that the player has accumulated the 8-8-8 symbol combination 182 and the list of remaining predetermined symbol combinations 184 shown on the information window 180 that appears in the symbol matrix 190.

In FIG. 11, another winning 7-7-7 symbol combination appears in the top positions 126, 128, 130, of first 156, second 158, and third columns 160 and awards 100 credits to the player in accordance with a pay schedule (not shown), with the credit award shown on the Paid meter 124. The game, however, does not indicate that the player has accumulated a second 7-7-7 symbol combination from the list of predetermined symbol combinations. The game only indicates the first occurrence of each member from a set of winning symbol combinations. As long as the player has credits on the Credit meter 116, the player may continue to play the game or the player may also collect the balance of credits by pressing the Cash Out button 102. In addition, the player may press the Help button 106 to view the rules of the game.

In FIG. 12, the player has decided to cash out of the Members embodiment of the game and upon cashing out receives a ticket 10 displaying the specific members from the set of winning symbol combinations (i.e. 7-7-7 and 8-8-8) accumulated 22 by the player during the three games of the player's gaming session (as shown in FIGS. 9-11), along with a list of the members not yet accumulated 23 (i.e. 1-1-1, 2-2-2, and 9-9-9-9-9). In addition, the ticket 10 includes the name of gaming location 24, a unique identifier of the gaming machine 26, the time and date of the issuance of the ticket 28, ticket identification number 30, and a secure validation code in alpha-numeric 32 and bar code 34 formats. Alternatively, a ticket produced by the Members embodiment may include any other information, such as the player's unique identification code, to be displayed in any form, such as bar coding, and/or include any form of security mechanism, such as holographic decals or magnetic striping. The player uses a Members ticket 10 to store the accumulated members from the set of symbol combinations for future use at the same or different gaming machine. Upon deciding to play another game session using the "Members" embodiment, the player may insert the ticket 10 into a ticket acceptor or reader (not shown). Upon validation of the ticket 10 by the stand alone gaming device, a network connecting multiple gaming machines to central servers, or other validation mechanism, the player then receives the accumulated number of members, as shown on the ticket 10 at 22, and may proceed to continue accumulating more members with additional game play (as described in the Members embodiment above).

DESCRIPTION OF ALTERNATIVE EMBODIMENTS

In addition to the preferred embodiments, as described above, the present invention may be modified in one or more aspects, including but not limited to the following alternative embodiments:

Alternative Gold Bar Embodiments

In an alternative Gold Bar embodiment, the Gold Bar symbols also act as a wildcard symbols to help form winning combinations. For example, "2-GB-GB-2" results in a winning "2-2-2-2" symbol combination with the GB symbol acting as a "2" symbol.

In another alternative Gold Bar embodiment, Gold Bar symbols may form winning symbol combinations by themselves. For example, "GB-GB-GB" results in a winning symbol combination.

In another alternative Gold Bar embodiment, each Gold Bar symbol may provide the player with one or more accumulated Gold Bars. For example, each Gold Bar symbol may provide the player with a random number of Gold Bars within a range of 1 to 5 Gold Bars. In another alternative Gold Bar embodiment, the player may accumulate one or more symbols. For example, the player may accumulate Gold Bar symbols and also accumulate Silver Bar symbols. In a further Gold Bar embodiment using one or more accumulated symbols, the player receives a ticket with the number of each accumulated symbol.

Alternative Points Embodiments

In an alternative Points embodiment, the player receives an award for accumulating a specific number of points. For example, the player receives an award for accumulating exactly 550, 1075, 2046, or 5008 points at the conclusion of any spin.

In another alternative Points embodiment, the number of points is capped at a predetermined number. For example, the player may accumulate up to 100,000 points.

In another alternative Points embodiment, the player may accumulate one or more types of points. For example, the player may accumulate Diamond Points from line pays and Platinum Points from scatter pays.

In another alternative embodiment, the player may accumulate points in accordance with any rate schedule. For example, the player may collect points at a rates of 5 times any line pays and/or 10 times any scatter pays.

In another alternative embodiment, the player may accumulate points for any symbol or symbol combination, whether or not such symbol or symbol combination appears on a pay schedule. For example, the player may accumulate 10 points for each "7" symbol that appears in the symbol matrix even though there is no associated award for a single "7" symbol in the pay schedule.

Alternative Members Embodiments

In an alternative Members embodiment, the player may accumulate one or more of each member of a predetermined set of symbol combinations. For example, the player may accumulate two "2-2-2" members and six "4-4-4-4" members from a predetermined list of symbol combinations including "2-2-2" and "4-4-4-4."

In another alternative Members embodiment, the player may only need to accumulate a sub-set of the predetermined symbol combinations to collect an award. For example, the player may only need to collect 7 of the 10 predetermined symbol combinations to collect an award.

In another alternative Members embodiment, the predetermined set of symbol combinations may include any combination of symbols including combinations that are not listed on a pay schedule. For example, the predetermined set of the symbol combinations may include "2-4-7" even though there is no associated award for the "2-4-7" symbol combination in the pay schedule.

In another alternative Members embodiment, the game provides one or more lists of predetermined symbol combinations. For example, one list includes 3 symbol combinations and a small associated award for accumulating all 3 combinations; and another list includes 20 symbol combinations and a large associated award for accumulating all 20 combinations.

In another alternative Members embodiment, the player receives a ticket with all of the accumulated members and a list of all the non-accumulated members. For example, the player receives a ticket with "2-2-2" marked as accumulated and "3-3-3" and "4-44" marked as not accumulated.

General Alternative Embodiments

In an alternative embodiment of the present invention, the ticket printer may be part of a stand-alone gaming device. For example, the ticket printer operates in conjunction with a CPU and hard drive to generate tickets listing accumulated elements, store data related to issued tickets, and validate existing tickets inserted into the gaming machine by the player.

In another alternative embodiment, the ticket printer may be part of a network of gaming devices. For example, the ticket printer exchanges information across network cables with a central server to generate tickets listing accumulated elements, store data related to issued tickets, and validate existing tickets inserted into the gaming machine by the player. In another alternative embodiment, the ticket printer may print a ticket for each group of one or more elements accumulated by the player. For example, the ticket printer may print out a ticket for each member accumulated from a predetermined set of symbol combinations.

In another alternative embodiment, the ticket printer may print a ticket for each award issued by the gaming device generated by the accumulation of elements. For example, the ticket printer may print a ticket with a credit award or other prize for accumulating 10 Gold Bars, 1000 points, and/or a set of all members of a predetermined set of symbol combinations.

In another alternative embodiment, the player may accumulate in elements in a specific part and/or period of the game. For example, the player may only accumulate elements during play of a secondary free spin bonus game. In another alternative embodiment, the player must make a separate wager to accumulate and/or record elements during the play of the game. For example, the player must wager 10 additional credits to accumulate and record the number of Gold Bar symbols appearing during one or more spins of a game.

In another alternative embodiment, the player may accumulate elements during play of a poker, bingo, keno, or other casino-related game. For example, the player may accumulate members of a set of predetermined poker hands in video draw poker game.

Scope & Spirit of the Present Invention

The many features and advantages of the present invention are apparent from the descriptions of the preferred and alternative embodiments. The present invention, however, is not limited to these particular embodiments, as the invention is capable of being practiced and carried out in various ways. For example, new features may be added to an existing embodiment or features from two or more embodiments may be combined to produce a new embodiment.

Further, features mentioned in any embodiment may be interchanged with similar features not mentioned that perform the same or similar functions. And, finally, the phraseology and terminology used to explain the embodiments are only descriptive and should not be regarded as limiting. The claims, therefore, seek to cover all features and advantages that fall within the true spirit and scope of the present invention.

The invention claimed is:

1. A machine comprising:

a plurality of reels, each of the reels including a plurality of symbol positions;

a display on a display device of a portion of the reels and a ticket storing a player's accumulated points;

wherein the player accumulates a plurality of non-monetary points based upon predetermined symbols being displayed on the display device over a series of spins;

an input device wherein the player can select to redeem accumulated non-monetary points in any of a plurality of games.

2. The machine of claim 1 wherein the player redeems accumulated non-monetary points for a free spin.

3. The machine of claim 1 wherein the player redeems accumulated non-monetary points to unlock a feature.

4. The machine of claim 1 wherein the player redeems accumulated non-monetary points to unlock a game.

5. The machine of claim 1 wherein the player can only redeem accumulated non-monetary points when the player has accumulated a predetermined number of points.

6. A machine comprising:

a plurality of reels, each of the reels including a plurality of symbol positions;

a display on a display device of a portion of the reels and a ticket storing a player's accumulated members;

wherein the members are a predetermined set of symbols;

wherein the player accumulates members based upon a symbol corresponding to the member being displayed on the display device over a series of spins;

an input device wherein the player can select to redeem accumulated members in any of a plurality of games.

7. The machine of claim 6 wherein the player accumulates a member if the corresponding predetermined symbol is in a winning symbol combination.

8. The machine of claim 6 wherein the player can only redeem accumulated members if the player has accumulated at least one of each predetermined member.

9. The machine of claim 8 wherein the player can only store a predetermined number of each accumulated member.

10. The machine of claim 9 wherein the predetermined number is one.

11. The machine of claim 6 wherein the player can redeem awards based on how many of a particular member the player has accumulated.

12. The machine of claim 11 wherein the redeemed award is multiplied by the number of a particular member the player has accumulated.

13. The machine of claim 6 wherein the player can redeem a specific award for the accumulation of each member.

14. A system comprising:

a ticket to store a player's accumulated points;

a plurality of machines, each machine comprising:

a plurality of reels, each of the reels including a plurality of symbol positions;

a display on a display device of a portion of the reels and the ticket;

an input device wherein the player can select to redeem accumulated points;

wherein the player accumulates points based upon predetermined symbols being displayed on at least one of the display devices over a series of spins and wherein points accumulate if a corresponding predetermined symbol is in a winning symbol combination.

15. The system of claim 14 wherein the player accumulates points on one machine and redeems points on another machine.

16. The system of claim 15 wherein the player redeems accumulated points for a free spin.

17. The system of claim 15 wherein the player redeems accumulated points to unlock a feature.

18. The system of claim 14 wherein the player redeems accumulated points for a free spin.

19. The system of claim 14 wherein the player redeems accumulated points to unlock a feature.

* * * * *